US008033893B2

(12) United States Patent
Haneda et al.

(10) Patent No.: US 8,033,893 B2
(45) Date of Patent: Oct. 11, 2011

(54) GRINDING METHOD OF A DISK-SHAPED SUBSTRATE AND GRINDING APPARATUS

(75) Inventors: Kazuyuki Haneda, Ichihara (JP); Satoshi Fujinami, Minamitsuru-gun (JP)

(73) Assignees: Showa Denko K.K., Tokyo (JP); Citizen Seimitsu Co., Ltd., Yamanashi (JP)

( * ) Notice: Subject to any disclaimer, the term of this patent is extended or adjusted under 35 U.S.C. 154(b) by 823 days.

(21) Appl. No.: 12/014,392

(22) Filed: Jan. 15, 2008

(65) Prior Publication Data

US 2008/0176488 A1 Jul. 24, 2008

(30) Foreign Application Priority Data

Jan. 18, 2007 (JP) ..... 2007-008860

(51) Int. Cl.
*B24B 9/08* (2006.01)

(52) U.S. Cl. ..... 451/5; 451/44; 451/61

(58) Field of Classification Search ..... 451/57, 451/58, 44, 61, 5, 27, 65
See application file for complete search history.

(56) References Cited

U.S. PATENT DOCUMENTS

| | | | | |
|---|---|---|---|---|
| 4,793,101 | A * | 12/1988 | Dlouhy et al. | 451/44 |
| 6,991,521 | B2 * | 1/2006 | Hagan et al. | 451/44 |
| 2006/0228997 | A1 * | 10/2006 | Chida et al. | 451/11 |

FOREIGN PATENT DOCUMENTS

| | | | |
|---|---|---|---|
| JP | 63-201048 | U | 12/1988 |
| JP | 02-036058 | A | 2/1990 |
| JP | 08-057756 | A | 3/1996 |
| JP | 11-349354 | A | 12/1999 |
| JP | 2000-326191 | A | 11/2000 |
| JP | 2001-006166 | A | 1/2001 |
| JP | 2001-105292 | A | 4/2001 |
| JP | 2003-231044 | A | 8/2003 |
| JP | 2005-014176 | A | 1/2005 |
| JP | 2005-103652 | A | 4/2005 |
| JP | 2006-068832 | A | 3/2006 |

* cited by examiner

*Primary Examiner* — Robert Rose

(74) *Attorney, Agent, or Firm* — Sughrue Mion, PLLC

(57) ABSTRACT

The grinding method of a disk-shaped substrate that grinds a disk-shaped substrate including a portion having a hole at the center thereof while rotating the disk-shaped substrate is provided with: grinding an inner circumference of the disk-shaped substrate while an inner circumference grinding device is fed in a radial direction toward an outer circumference of the disk-shaped substrate and grinding the outer circumference of the disk-shaped substrate while an outer circumference grinding device is fed in the radial direction toward the inner circumference of the disk-shaped substrate; and stopping the feedings of the inner circumference grinding device and the outer circumference grinding device at the same time.

8 Claims, 7 Drawing Sheets

FIRST LAPPING PROCESS

INNER AND OUTER CIRCUMFERENCE GRINDING PROCESS

OUTER CIRCUMFERENCE POLISHING PROCESS

SECOND LAPPING PROCESS

INNER CIRCUMFERENCE POLISHING PROCESS

FIRST POLISHING PROCESS

SECOND POLISHING PROCESS

FINAL WASHING AND INSPECTION PROCESS

GRINDING METHOD OF A DISK-SHAPED SUBSTRATE AND GRINDING APPARATUS

CROSS REFERENCE TO RELATED APPLICATIONS

This application is based on and claims priority under 35 USC §119 from Japanese Patent Application No. 2007-8860 filed Jan. 18, 2007.

BACKGROUND OF THE INVENTION

1. Field of the Invention

The present invention relates to a grinding method and a grinding apparatus of a disk-shaped substrate such as a glass substrate for a magnetic recording medium, and especially relates to a grinding method and a grinding apparatus for grinding an outer circumference and an inner circumference of a disk-shaped substrate.

2. Description of the Related Art

In recent years, the production of disk substrates as disk-shaped substrates has been activated, under increased demands as recording media. As a magnetic disk substrate as one of the disk substrates, an aluminum substrate and a glass substrate are widely used. The aluminum substrate is characterized by its high processability and low cost, meanwhile the glass substrate is characterized by its excellent strength, surface smoothness, and flatness. In particular, requirements for compact size and high density of disk substrates recently have become extremely high, and the glass substrate of which surface roughness is small and that enables high density has attracted a lot of attention.

Various improvements have been made in a manufacturing apparatus of magnetic disk substrates. As the related art described in official gazettes, there is an art of grinding the outer and inner circumferential surfaces of a disk-shaped substrate (a glass substrate, a glass disk) including a portion having a hole at the center (for example, refer to Patent Documents 1 and 2).

In the Patent Document 1, in an inner and outer circumferential surface grinding work apparatus of a glass disk, a related art that performs plural processes in parallel at the same time is disclosed. In the art, a grinding stone for working the outer circumferential surface and a grinding stone for working the inner circumferential surface are displaced with respect to a glass disk fixed to a turn table so as to be brought into contact with the outer circumferential surface and the inner circumferential surface of the glass disk for performing the outer circumferential surface work and inner circumferential surface work in parallel at the same time.

In Patent Document 2, an edge face and a slant face of an outer circumferential portion and an inner circumferential portion of a glass substrate for a hard disk are ground at the same time by a metal bond outer surface grinding stone and a metal bond inner surface grinding stone.

Moreover, the metal bond outer surface grinding stone and the metal bond inner surface grinding stone have plural trapezoid grooves (ten grooves) provided on the same axis with a predetermined interval, in which a half of the ten trapezoid grooves are molded for rough working and the remaining trapezoid grooves for finishing. Further, the edge face and the slant face of the outer circumferential portion of the glass substrate are worked at the same time by the metal bond outer surface grinding stone, while the edge face and the slant face of the inner circumference portion on the glass substrate are worked at the same time by the metal bond inner surface grinding stone.

[Patent Document 1]

Japanese Unexamined Patent Application Publication No. 2005-14176.

[Patent Document 2]

Japanese Unexamined Patent Application Publication No. 2001-105292.

As mentioned above, there has been known such an art where an inner circumferential surface (inner circumference) and an outer circumferential surface (outer circumference) of a disk-shaped substrate are ground at the same time. However, grinding contents including work rates are different between grinding on the outer circumference and grinding on the inner circumference such that contact by the grinding stone is in the point contact state on the outer circumference as compared with the inner circumference and a distance to be ground (distance in the circumferential direction) is larger on the outer circumference than on the inner circumference, and moreover, there are a difference in a load on a grinding stone shaft, a difference in circumferential velocity between inner and outer circumferences of a disk-shaped substrate and the like. Further, even when the grinding contents are different as above, high dimensional accuracy and high concentricity are in demand both in the inner and outer circumferences after grinding. Thus, when the inner and outer circumferences of a disk-shaped substrate are ground at the same time, favorable grinding results may not be obtained unless more appropriate grinding conditions are determined.

The present invention is made in order to address the above technical problem and has an object to improve the concentricity of the inner and outer circumferences after grinding in outer circumferential grinding and inner circumferential grinding of a disk-shaped substrate.

Another object of the present invention is to reduce time required for work and to maintain high dimensional accuracy of the inner and outer circumferences after grinding in the outer and inner circumferential grinding of a disk-shaped substrate.

SUMMARY OF THE INVENTION

According to an aspect of the invention, there is provided a grinding method of a disk-shaped substrate that grinds a disk-shaped substrate including a portion having a hole at the center thereof while rotating the disk-shaped substrate including: grinding an inner circumference of the disk-shaped substrate while an inner circumference grinding device is fed in a radial direction toward an outer circumference of the disk-shaped substrate and grinding the outer circumference of the disk-shaped substrate while an outer circumference grinding device is fed in the radial direction toward the inner circumference of the disk-shaped substrate; and stopping the feedings of the inner circumference grinding device and the outer circumference grinding device at the same time.

In one aspect of the grinding method of a disk-shaped substrate of the present invention, the grinding method of a disk-shaped substrate further includes removing a portion remaining on the inner circumference and the outer circumference of the disk-shaped substrate by continuing rotation of the disk-shaped substrate for a determined time in the state of stopping the feedings.

In another aspect of the grinding method of a disk-shaped substrate of the present invention, the disk-shaped substrate is held by a holding device that presses and holds upper and lower surfaces of the disk-shaped substrate.

In further aspect of the grinding method of a disk-shaped substrate of the present invention, the inner circumference grinding device and the outer circumference grinding device have rotatable grinding surfaces.

In furthermore aspect of the grinding method of a disk-shaped substrate of the present invention, each of the inner circumference grinding device and the outer circumference grinding device has a rough grinding portion and a finishing grinding portion.

In furthermore aspect of the grinding method of a disk-shaped substrate of the present invention, the feedings of the inner circumference grinding device and the outer circumference grinding device in the radial direction are stopped at the same time in grinding by the rough grinding portions; and the inner circumference grinding device and the outer circumference grinding device are rotated for a predetermined time in a state where the positions of the inner circumference grinding device and the outer circumference grinding device are maintained.

In furthermore aspect of the grinding method of a disk-shaped substrate of the present invention, the inner circumference grinding device and the outer circumference grinding device are grinding stones that continuously form the rough grinding portion and the finishing grinding portion in an axial direction thereof; and after grinding by the rough grinding portion, grinding by the finishing grinding portion is performed by moving the inner circumference grinding device and the outer circumference grinding device in the axial direction so that the finishing grinding portion is opposed to the disk-shaped substrate.

In furthermore aspect of the grinding method of a disk-shaped substrate of the present invention, the feedings of the inner circumference grinding device and the outer circumference grinding device in the radial direction are stopped at the same time during grinding by the finishing grinding portion; and the inner circumference grinding device and the outer circumference grinding device are rotated for a predetermined time in a state where the positions of the inner circumference grinding device and the outer circumference grinding device are maintained.

A grinding apparatus of the present invention is provided with: an inner circumference grinding stone that grinds an inner circumference of a disk-shaped substrate; an outer circumference grinding stone that grinds an outer circumference of the disk-shaped substrate; an inner circumference grinding stone moving mechanism that moves the inner circumference grinding stone in a radial direction toward the outer circumference of the disk-shaped substrate; an outer circumference grinding stone moving mechanism that moves the outer circumference grinding stone in the radial direction toward the inner circumference of the disk-shaped substrate; and a controller that operates the inner circumference grinding stone moving mechanism and the outer circumference grinding stone moving mechanism while rotating the inner circumference grinding stone and the outer circumference grinding stone, and stops the inner circumference grinding stone moving mechanism and the outer circumference grinding stone moving mechanism at the same time so as to grind the disk-shaped substrate.

In one aspect of the grinding apparatus of the present invention, the controller performs grinding by the inner circumference grinding stone and the outer circumference grinding stone while making the disk-shaped substrate rotated.

In another aspect of the grinding apparatus of the present invention, the controller controls so that a moving distance of the inner circumference grinding stone by the inner circumference grinding stone moving mechanism corresponds to a moving distance of the outer circumference grinding stone by the outer circumference grinding stone moving mechanism.

In further aspect of the grinding apparatus of the present invention, the controller rotates the inner circumference grinding stone and the outer circumference grinding stone for a predetermined time in a state where the positions of the inner circumference grinding stone and the outer circumference grinding stone are maintained, after making the inner circumference grinding stone moving mechanism and the outer circumference grinding stone moving mechanism operated and stopped at the same time.

In furthermore aspect of the grinding apparatus of the present invention, the inner circumference grinding stone is provided with: a rough grinding surface that performs rough grinding of the inner circumference of the disk-shaped substrate; and a finishing grinding surface that is continuously provided to the rough grinding surface in an axial direction thereof and performs finishing grinding of the inner circumference, and the outer circumference grinding stone is provided with: a rough grinding surface that performs rough grinding of the outer circumference of the disk-shaped substrate; and a finishing grinding surface that is continuously provided to the rough grinding surface in the axial direction and performs finishing grinding of the outer circumference.

In furthermore aspect of the grinding apparatus of the present invention, the grinding apparatus is further provided with a rotating shaft that holds the inner circumference grinding stone from one side and rotates the inner circumference grinding stone. The inner circumference grinding stone has the finishing grinding surface at a position proximal to the rotating shaft and the rough grinding surface at a position distal to the rotating shaft.

In furthermore aspect of the grinding apparatus of the present invention, the grinding apparatus is further provided with a rotating shaft that holds the outer circumference grinding stone from one side and rotates the outer circumference grinding stone. The outer circumference grinding stone has the finishing grinding surface at a position proximal to the rotating shaft and the rough grinding surface at a position distal to the rotating shaft.

BRIEF DESCRIPTION OF THE DRAWINGS

The nature, utility, and further features of the present invention will be more clearly apparent from the following detailed description with respect to preferred embodiments of the invention when read in conjunction with the accompanying drawings briefly described below wherein.

DETAILED DESCRIPTION OF THE EMBODIMENTS

Hereinafter, exemplary embodiments of the present invention will be described in detail with reference to the attached drawings.

FIG. 1A to FIG. 1H are diagrams illustrating the manufacturing process of a disk-shaped substrate (a disk substrate) to which the present exemplary embodiment is applied. In this manufacturing process, first, in a first lapping process shown in FIG. 1A, raw materials of disk-shaped substrates 10 (workpieces) are put on a fixed base 21, and flat surfaces 11 of the disk-shaped substrates 10 are ground. At this moment, on the surface of the fixed base 21 on which the disk-shaped substrates 10 are put, for example, abrasives of diamond are dispersed and spread.

Figure 1A:
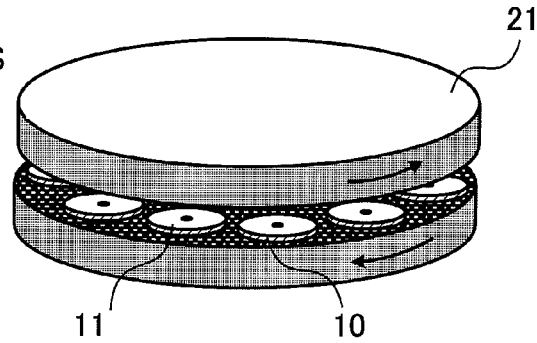
FIG. 1A to FIG. 1H are diagrams illustrating the manufacturing process of a disk-shaped substrate (a disk substrate) to which the exemplary embodiment is applied.
Figure 1B:
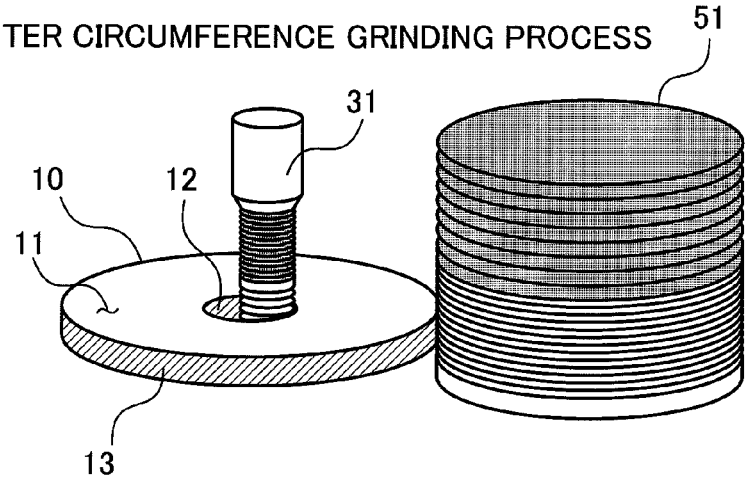

Next, in an inner and outer circumference grinding process shown in FIG. 1B, a inner circumference 12 of the portion having a hole formed at the center of the disk-shaped substrate 10 is ground by an inner circumference grind stone 31, and the outer circumference 13 of the disk-shaped substrate 10 is ground by an outer circumference grind stone 51. At this moment, an area of the inner circumference 12 (the inner circumferential surface) and an area of the outer circumference 13 (the outer circumferential surface) of the disk-shaped substrate 10 are held in the radial direction and processed at the same time by the inner circumference grind stone 31 and the outer circumference grind stone 51, and thereby coaxial degrees (concentricity) of the inner diameter and the outer diameter are easily secured. On the surfaces of the inner circumference grind stone 31 and the outer circumference grind stone 51, for example, abrasives of diamond are dispersed and spread. Here, the inner circumference grind stone 31 is an example of an inner circumference grinding device, and the outer circumference grind stone 51 is an example of an outer circumference grinding device.

Figure 1C:
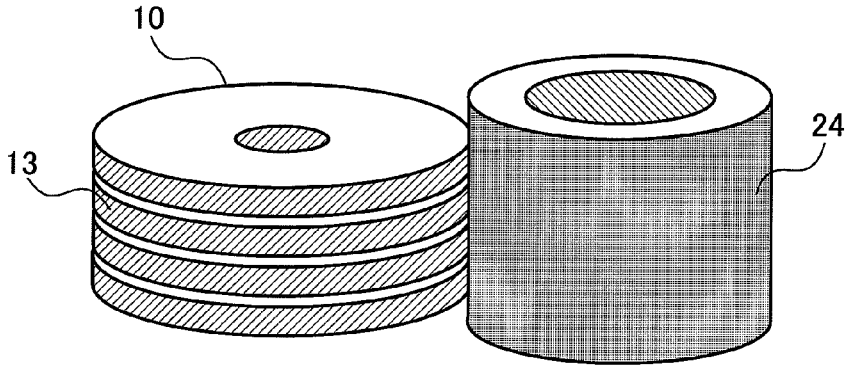
Figure 1D:
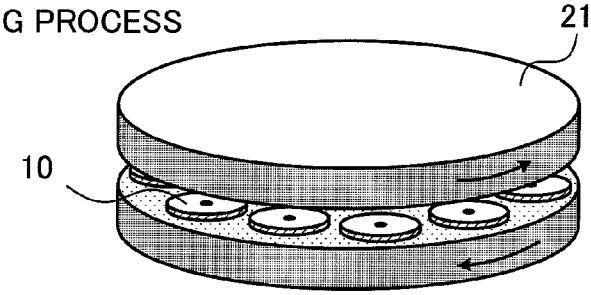

Then, in an outer circumference polishing process shown in FIG. 1C, the outer circumferences 13 of the disk-shaped substrates 10 are polished by use of an outer circumference polishing brush 24. Thereafter, in a second lapping process shown in FIG. 1D, the disk-shaped substrates 10 are mounted on the fixed base 21, and the flat surfaces 11 of the disk-shaped substrates 10 are further ground.

Figure 1E:
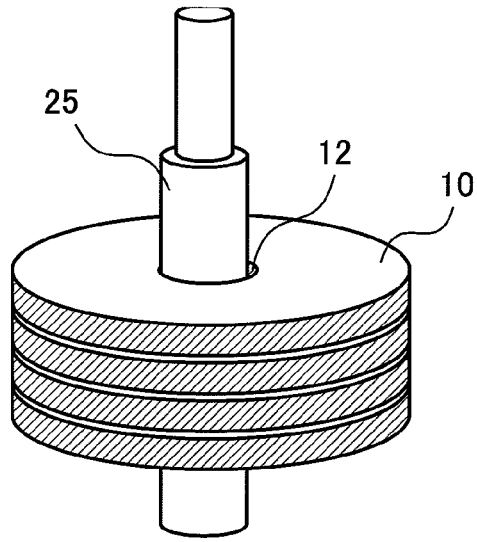
Figure 1F:
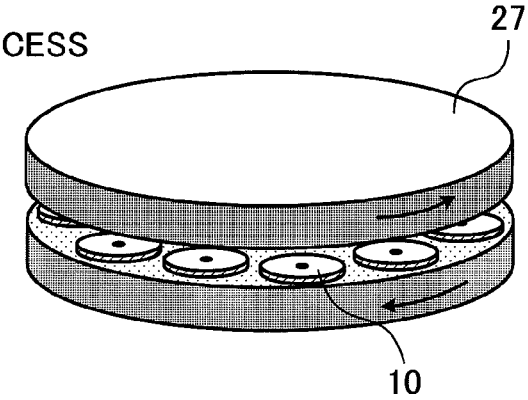
Figure 1G:
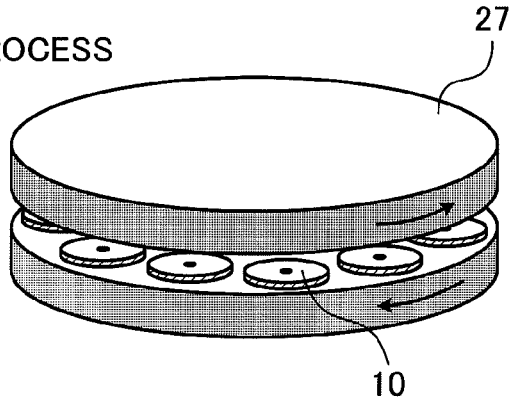
Figure 1H:
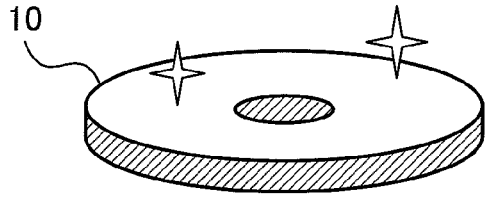

Next, in an inner circumference polishing process shown in FIG. 1E, a brush 25 is inserted into the portions having the hole at the center of the disk-shaped substrates 10, and the inner circumference 12 of the disk-shaped substrates 10 are polished. Thereafter, in a first polishing process shown in FIG. 1F, the disk-shaped substrates 10 are mounted on the fixed base 27, and the flat surfaces 11 of the disk-shaped substrates 10 are polished. In the polishing process at this moment, for example, hard polisher is used as non-woven cloth (polishing cloth). Further, in the second polishing process shown in FIG. 1G, the flat surfaces are polished by use of soft polisher. Thereafter, in a final washing and inspection process shown in FIG. 1H, washing and inspection are carried out, and thereby the disk-shaped substrates (disk substrates) 10 are manufactured.

An inner and outer circumference grinding process shown in FIG. 1B, which is a process characterized by the present exemplary embodiment, will be described below in detail.

Figure 2:
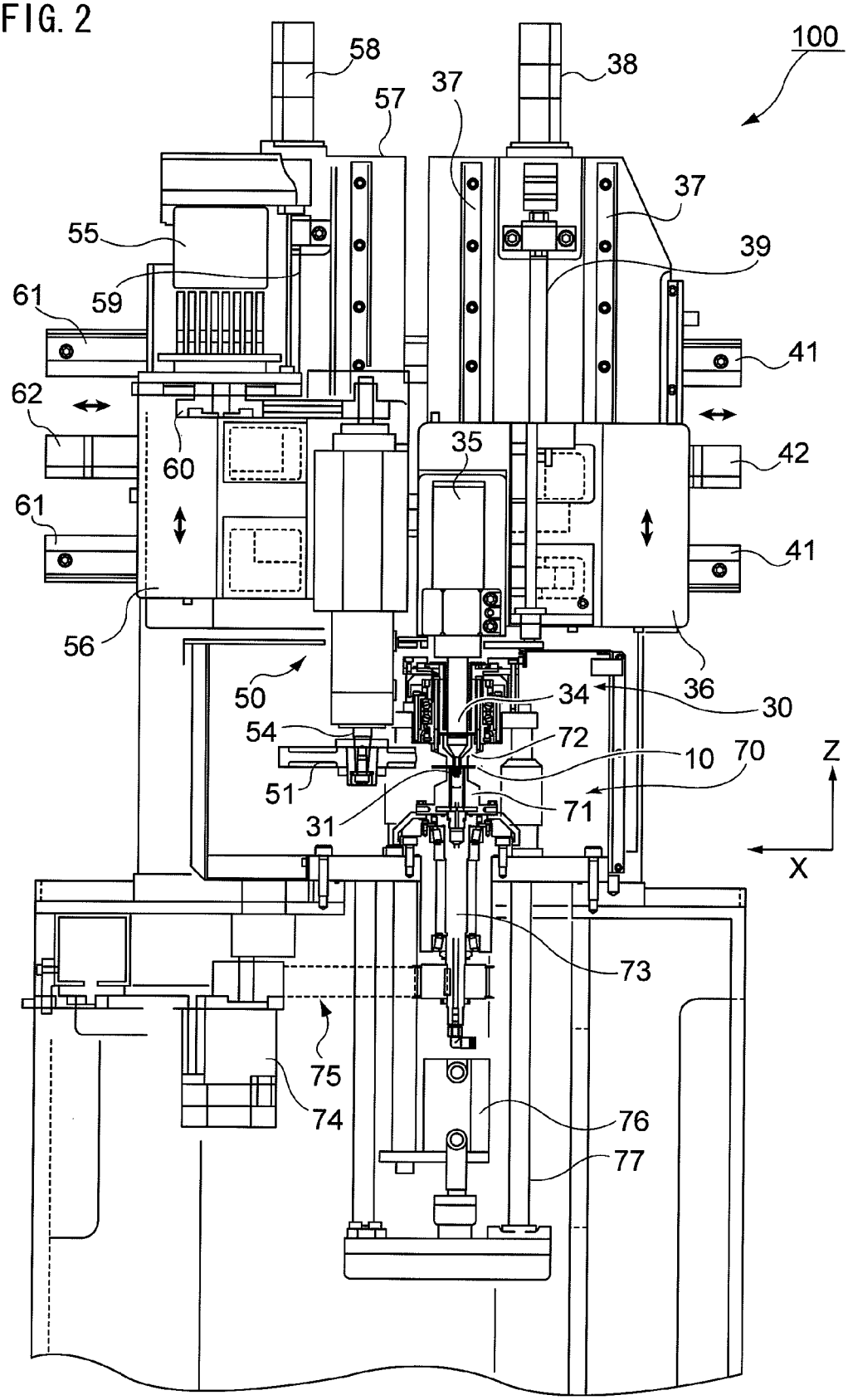
FIG. 2 shows an entire block diagram of the grinding apparatus.
Figure 3:
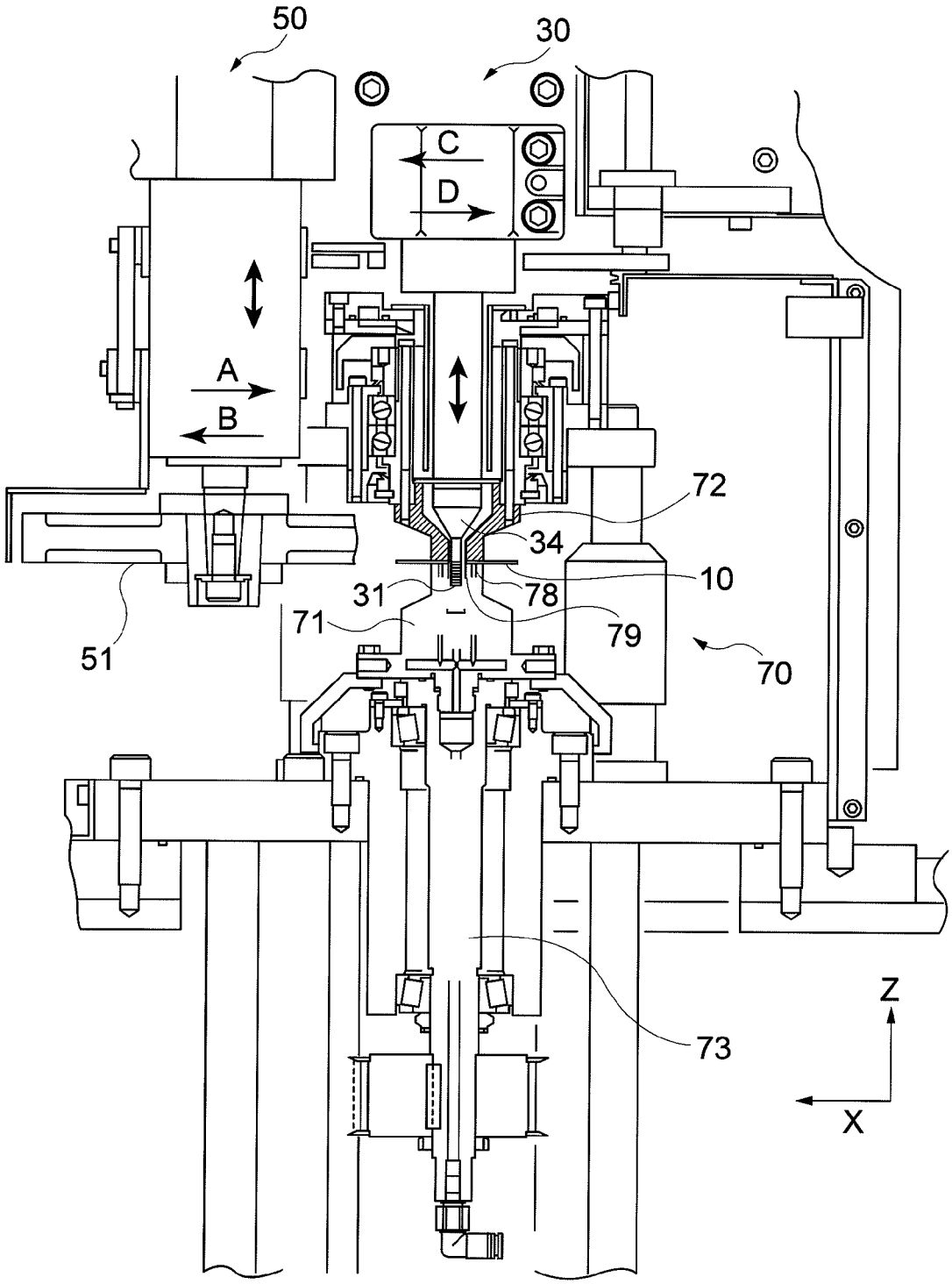
FIG. 3 shows a grinding mechanism portion in the grinding apparatus that grinds a disk-shaped substrate in an enlarged manner.
Figure 4:
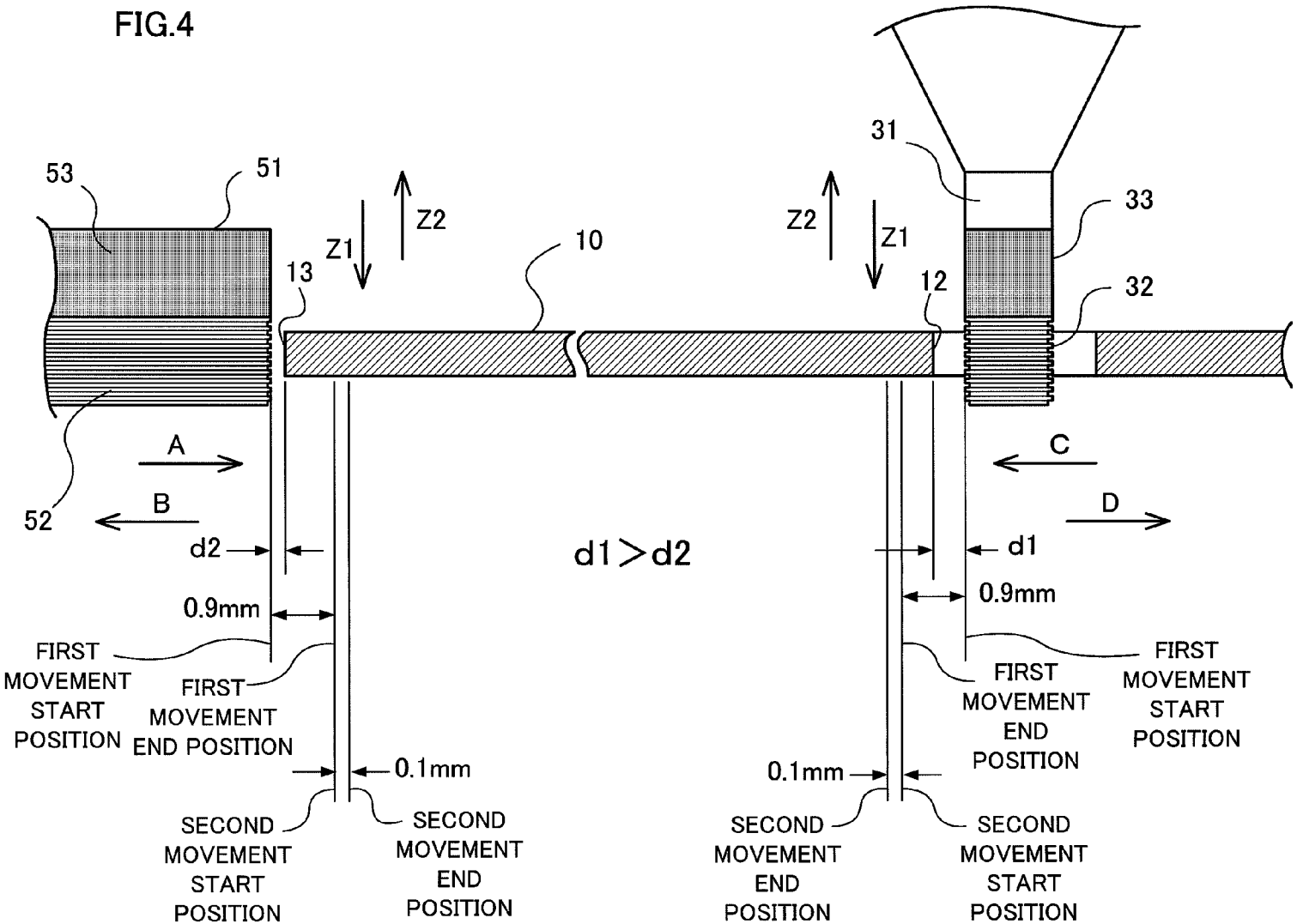
FIG. 4 illustrates a relation between the disk-shaped substrate and an inner circumference grinding stone as well as an outer circumference grinding stone on a plane axis.

First, using FIGS. 2 to 4, a grinding apparatus 100 used in the inner and outer circumference grinding process will be explained. FIG. 2 shows an entire block diagram of the grinding apparatus 100, and FIG. 3 shows a grinding mechanism portion in the grinding apparatus 100 that grinds a disk-shaped substrate 10 in an enlarged manner. In addition, FIG. 4 illustrates a relation between the disk-shaped substrate 10 and an inner circumference grinding stone 31 as well as an outer circumference grinding stone 51 on a plane axis.

The grinding apparatus 100 to which the present exemplary embodiment is applied includes an inner circumferential grinding mechanism 30 that grinds an inner circumference 12 of the disk-shaped substrate 10 as a workpiece, an outer circumferential grinding mechanism 50 that grinds an outer circumference 13 of the disk-shaped substrate 10, and a substrate holding and rotating mechanism 70 that presses and holds upper and lower side of the disk-shaped substrate 10 and rotates the held disk-shaped substrate 10. Additionally, operations of the inner circumferential grinding mechanism 30, the outer circumferential grinding mechanism 50, and the substrate holding and rotating mechanism 70 are controlled by a controller (not shown in the figure). Here, the substrate holding and rotating mechanism 70 is an example of a holding device.

The inner circumferential grinding mechanism 30 includes, as shown in FIGS. 2 and 3, an inner circumference grinding stone 31 having a rotating grinding surface and a rotating shaft 34 that holds the inner circumference grinding stone 31 from one side and rotates the inner circumference grinding stone 31. In addition, as shown in FIG. 2, a rotary driving unit 35 that rotates the inner circumference grinding stone 31 and an inner circumference grinding stone table 36 that holds and moves the rotary driving unit 35 in a Z-axis direction in the figure (vertical direction in the figure) are also provided. Moreover, as a Z-axis direction moving mechanism that moves the inner circumference grinding stone table 36 in the Z-axis direction, a slide rail 37, a servo motor 38 that is a driving source and a ball screw 39 that changes a rotating force of the servo motor 38 to movement in a sliding direction of the inner circumference grinding stone table 36 are provided. Further, as an X-axis direction moving mechanism that moves the inner circumference grinding stone table 36 and the Z-axis direction moving mechanism in the X-axis direction (C direction and D direction in FIG. 4, radial direction of the disk-shaped substrate 10), a slide rail 41 and a servo motor 42 which is a driving source are provided.

The inner circumference grinding stone 31 has a structure in which diamond particles, for example, are dispersed in SK material (carbon tool steel material). As shown in FIG. 4, a rough grinding surface (rough grinding portion) 32 in which the diamond is roughly dispersed is provided on a tip end side in a lower part in the figure for rough grinding. A finishing grinding surface (finishing grinding portion) 33 is provided continuously to the rough grinding surface 32 in the axial direction and integrally on the rotating shaft side. In the finishing grinding surface 33, diamond is densely dispersed for finishing. Here, higher accuracy in the cutting by the finishing grinding surface 33 than the cutting by the rough grinding surface 32 is required. Therefore, considering an influence by uneven rotation, the finishing grinding surface 33 is provided proximal to the rotating shaft 34, while the rough grinding surface 32 is provided distal to the rotating shaft 34 with larger uneven rotation. Additionally, the lengths of the rough grinding surface 32 and the finishing grinding surface 33 in the Z-axis direction are sufficiently longer than a thickness of the disk-shaped substrate 10.

In the inner circumferential grinding mechanism 30, the inner circumference grinding stone 31 is located at an upper part of the Z-axis with respect to a grinding position where the disk-shaped substrate 10 is mounted, in a state before grinding. When the disk-shaped substrate 10 is pressed and held by the substrate holding and rotating mechanism 70 at the upper and lower sides, the servo motor 38 shown in FIG. 2 is driven, and the inner circumference grinding stone table 36 is moved downward of the Z-axis (Z1 direction in FIG. 4) by the ball screw 39 and the slide rail 37. Further, by control of the servo motor 38, either one of the rough grinding surface 32 and the finishing grinding surface 33 shown in FIG. 4 is opposed to the inner circumference 12 of the disk-shaped substrate 10. Moreover, at transition from the rough grinding work to the finishing grinding work or when the grinding work is finished, the inner circumference grinding stone table 36 is moved upward of the Z-axis (Z2 direction in FIG. 4) by rotary driving of the servo motor 38, the ball screw 39 and the slide rail 37.

In the inner circumferential grinding mechanism 30, a tooth top of the inner circumference grinding stone 31 is moved, for example, from a movement start position (first movement start position or second movement start position) to a movement end position (first movement end position or second movement end position) in the C direction (outer circumferential direction) in FIG. 4 at grinding. At this time, a rotary driving force by the rotary driving unit 35 is applied to the rotating shaft 34 so as to rotate the inner circumference grinding stone 31 in one direction. After the grinding is finished, the tooth top of the inner circumference grinding stone 31 is moved from the movement end position in FIG. 4 to a predetermined position in the D direction, for example. At the movement in the C direction and the D direction, the servo motor 42 shown in FIG. 2 is driven so that that the inner circumference grinding stone table 36 and the Z-axis direction moving mechanism are moved by action of the slide rail 41, a ball screw not shown in the figure and the like.

The outer circumferential grinding mechanism 50 includes, as shown in FIG. 2, an outer circumference grinding stone 51 that has a rotating grinding surface and a rotating shaft 54 that holds the outer circumference grinding stone 51 from one side and rotates the outer circumference grinding stone 51. In addition, a rotary driving unit 55 that rotates the outer circumference grinding stone 51 and a transmission mechanism 60 that transmits the rotating force from the rotary driving unit 55 to the rotating shaft 54 are also provided. Moreover, an outer circumference grinding stone table 56 that holds and moves the rotary driving unit 55 and the transmission mechanism 60 in the Z-axis direction in the figure (vertical direction in the figure) are also provided. Further, as a Z-axis direction moving mechanism that moves the outer circumference grinding stone table 56 in the Z-axis direction, a slide rail 57, a servo motor 58 that is a driving source and a ball screw 59 that changes a rotating force of the servo motor 58 to movement in a sliding direction of the outer circumference grinding stone table 56 are provided. Furthermore, as an X-axis direction moving mechanism that moves the outer circumference grinding stone table 56 and the Z-axis direction moving mechanism in the X-axis direction (radial direction of the disk-shaped substrate 10), a slide rail 61 and a servo motor 62 that is a driving source are provided.

Here, the X-axis direction defined in the present exemplary embodiment refers to a radial direction of the disk-shaped substrate 10 with respect to the Z-axis direction, which is a vertical direction in the figure, and is a plane axis (horizontal axis) formed by the X-axis and Y-axis defined by so-called triaxial (XYZ axes) direction. In addition, in an example shown in FIGS. 2 and 3, the center of the disk-shaped substrate 10 held by the substrate holding and rotating mechanism 70 and the center shaft of the outer circumference grinding stone 51 are not on the left side in the figure but in a relation having a predetermined angle toward the front side on the paper surface (or rear side on the paper surface).

The outer circumference grinding stone 51 has a structure in which, for example, diamond particles are dispersed in SK material similarly to the inner circumference grinding stone 31. As shown in FIG. 4, a rough grinding surface (rough grinding portion) 52 in which the diamond is roughly dispersed is provided in a lower part in the figure for rough grinding similarly to the inner circumference grinding stone 31. A finishing grinding surface (finishing grinding portion) 53 is provided continuously to the rough grinding surface 52 in the axial direction and integrally on the upper side. In finishing grinding surface 53, diamond is densely dispersed for finishing. The finishing grinding surface 53 is provided on the upper side in order to reduce influence of uneven rotation at the finishing grinding. The lengths in the Z-axis direction of the rough grinding surface 52 and the finishing grinding surface 53 are sufficiently longer than the thickness of the disk-shaped substrate 10. By making the lengths in the Z-axis direction of the rough grinding surface 32 of the inner circumference grinding stone 31 and the rough grinding surface 52 of the outer circumference grinding stone 51 substantially equal and by making the lengths in the Z-axis direction of the finishing grinding surface 33 of the inner circumference grinding stone 31 and the finishing grinding surface 53 of the outer circumference grinding stone 51 substantially equal, positions in the Z-axis direction of both grinding stones may be easily controlled at simultaneous grinding of the inner and outer circumferences.

In the outer circumferential grinding mechanism 50, similarly to the inner circumferential grinding mechanism 30, the outer circumference grinding stone 51 is located at an upper part with respect to a grinding position where the disk-shaped substrate 10 is mounted, in a state before grinding. When the disk-shaped substrate 10 is set (adjusted and held) to the substrate holding and rotating mechanism 70, the servo motor 58 shown in FIG. 2 is driven, and the outer circumference grinding stone table 56 is moved downward of the Z-axis (Z1 direction in FIG. 4) by the ball screw 59 and the slide rail 57. Further, by control of the servo motor 58, either one of the rough grinding surface 52 and the finishing grinding surface 53 shown in FIG. 4 is opposed to the outer circumference 13 of the disk-shaped substrate 10. Moreover, at transition from the rough grinding work to the finishing grinding work or when the grinding work is finished, the outer circumference grinding stone table 56 is moved upward of the Z-axis (Z2 direction in FIG. 4) by rotary driving of the servo motor 58, the ball screw 59 and the slide rail 57.

In the outer circumferential grinding mechanism 50, a tooth top of the outer circumference grinding stone 51 is moved, for example, from a movement start position to a movement end position in the A direction (inner circumferential direction) in FIG. 4 at grinding. At this time, a rotary driving force by the rotary drive unit 55 is applied to the rotating shaft 54 through the transmission mechanism 60 so as to rotate the outer circumference grinding stone 51 in one direction. After the grinding is finished, the tooth top of the outer circumference grinding stone 51 is moved from the movement end position in FIG. 4 to a predetermined position in the B direction, for example. At the movements, the servo motor 62 shown in FIG. 2 is driven so that the outer circumference grinding stone table 56 and the Z-axis direction moving mechanism are moved by action of the slide rail 61, a ball screw not shown in the figure and the like.

On the other hand, the substrate holding and rotating mechanism 70 is provided with, as shown in FIGS. 2 and 3, a first holding mechanism 71 and a second holding mechanism 72 that press and hold the upper and lower surfaces of the disk-shaped substrate 10. Further, as shown in FIG. 2, a rotating shaft 73 that rotates the disk-shaped substrate 10 held by the first holding mechanism 71 and the second holding mechanism 72, a driving source 74 that provides a driving force for rotation, and a transmission mechanism 75 that transmits the driving force from the driving source 74 to the rotating shaft 73 are provided. Moreover, as a mechanism that vertically moves the second holding mechanism 72 in the Z-axis direction, a cylinder 76 such as a hydraulic cylinder which is a driving source, and a transmission shaft 77 that transmits a driving force from the cylinder 76 to the second holding mechanism 72 are provided.

After the disk-shaped substrate 10 is placed and positioned on the first holding mechanism 71, the second holding mechanism 72 is moved downward in the figure by operation of the cylinder 76 through the transmission shaft 77 so as to press and hold the disk-shaped substrate 10 by the first holding mechanism 71 and the second holding mechanism 72. By this operation, the surface of the disk-shaped substrate 10 is pressed by the substrate holding and rotating mechanism 70 so as to press and hold the disk-shaped substrate 10 firmly. In addition, the driving force from the driving source 74 is transmitted to the rotating shaft 73 through the transmission mechanism 75 so as to rotate the first holding mechanism 71 and the second holding mechanism 72 that hold the disk-shaped substrate 10.

Further, as shown in FIG. 3, the first holding mechanism 71 is provided with a suction head 78 that suctions the disk-shaped substrate 10 mounted on a stage of the first holding mechanism 71 and a chuck mechanism 79 for centering with the inner circumference 12 of the disk-shaped substrate 10 as a reference.

The substrate holding and rotating mechanism 70 suctions the disk-shaped substrate 10 by the suction head 78 after the disk-shaped substrate 10 is placed on the stage at the tip end of the first holding mechanism 71. At this time, the chuck mechanism 79 is inserted into the inner circumference 12 of the disk-shaped substrate 10, for example, in a state where plural projection portions thereof expandable laterally are closed, and expands the plural projection portions evenly and laterally so as to specify the position of the inner circumference 12 and moves the disk-shaped substrate 10. By this operation, the disk-shaped substrate 10 is positioned and arranged on the first holding mechanism 71 in the centered state with respect to the inner circumference 12 of the disk-shaped substrate 10.

Next, a flow of inner and outer circumference grinding processing performed by the above-mentioned grinding apparatus 100 will be described.

Figure 5:
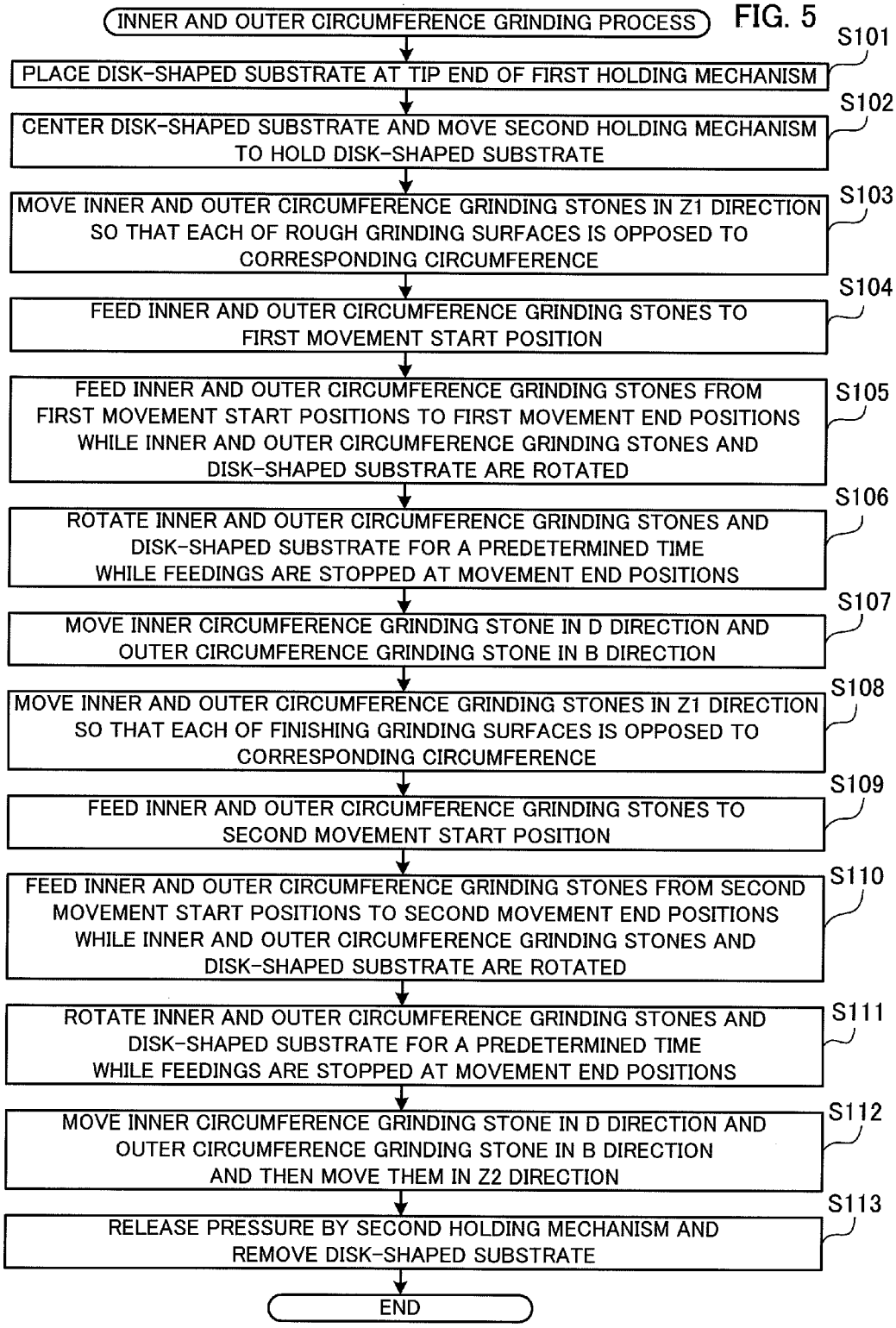
FIG. 5 is a flowchart illustrating processing of the inner and outer circumference grinding process.

FIG. 5 is a flowchart illustrating processing of the inner and outer circumference grinding process. Here, the grinding processing performed for every one substrate is shown and this processing is executed repeatedly for every one substrate. The description will be given with reference to FIGS. 2 to 4. First, the disk-shaped substrate 10 is placed at the tip end (the stage) of the first holding mechanism 71 using, for example, a robot mechanism (not shown in the figure) or the like (step 101). Then, by the operation of the above-mentioned chuck mechanism 79, centering is performed with respect to the inner circumference 12 of the disk-shaped substrate 10 and in a state where the disk-shaped substrate 10 is suctioned to the tip end (the stage) of the first holding mechanism 71 by the suction head 78, the second holding mechanism 72 is moved so as to hold the disk-shaped substrate 10 (step 102). For the holding of the disk-shaped substrate 10, the cylinder 76 is operated so that the second holding mechanism 72 is moved downward of the Z-axis in the figure through the transmission shaft 77.

After that, the inner circumference grinding stone 31 and the outer circumference grinding stone 51 are moved downward in the Z-axis in FIG. 3 (Z1 direction in FIG. 4) so that the rough grinding surface 32 of the inner circumference grinding stone 31 is opposed to the inner circumference 12 of the disk-shaped substrate 10 and the rough grinding surface 52 of the outer circumference grinding stone 51 to the outer circumference 13 of the disk-shaped substrate 10, as shown in FIG. 4 (step 103). In this process, movement of the inner circumference grinding stone 31 in the Z1 direction is carried out by driving the servo motor 38 shown in FIG. 2 so as to move the inner circumference grinding stone table 36 by the ball screw 39 and the slide rail 37. By controlling the rotation of the servo motor 38, the position of the inner circumference grinding stone 31 in the Z-axis direction is adjusted so that the rough grinding surface 32 of the inner circumference grinding stone 31 comes to a position capable of grinding the inner circumference 12.

Similarly, movement of the outer circumference grinding stone 51 in the Z1 direction is carried out by driving the servo motor 58 shown in FIG. 2 so as to move the outer circumference grinding stone table 56 by the ball screw 59 and the slide rail 57. By controlling the rotation of the servo motor 58, the position of the outer circumference grinding stone 51 in the Z-axis direction is adjusted so that the rough grinding surface 52 of the outer circumference grinding stone 51 comes to a position capable of grinding the outer circumference 13.

It should be noted that the position in the Z-axis direction is adjusted so as not to displace the edge face of the disk-shaped substrate 10 from the positions in the Z-axis direction (vertical positions) of the rough grinding surfaces 32 and 52. For example, the substantial center positions of the rough grinding surfaces 32 and 52 in the Z-axis direction is aligned with the center position of the disk-shaped substrate 10 in the Z-axis direction or the like.

Then, the inner circumference grinding stone 31 is moved in the C direction and the outer circumference grinding stone 51 in the A direction, and the inner circumference grinding stone 31 and the outer circumference grinding stone 51 are fed to the first movement start positions (See FIG. 4) (step 104). The first movement start positions are positions to start feeding of the grinding stones determined in order to finish the rough grinding of the inner circumference 12 and the outer circumference 13 (inner and outer circumferences) of the disk-shaped substrate 10 at the same time. The first movement start positions determine feeding of the inner circumference grinding stone 31 in the outer circumferential direction (the C direction) and feeding of the outer circumference grinding stone 51 in the inner circumferential direction (the A direction), and is determined as a value with a predetermined allowance considering an acceptable dimensional accuracy, cutting distance or the like of the disk-shaped substrate 10 (the workpiece) to be ground. It should be noted that, when they are set at the first movement start positions in advance before moving in the Z direction at the step 103, the processing at the step 104 may be omitted.

While the inner circumference grinding stone 31, the outer circumference grinding stone 51 and the disk-shaped substrate 10 are rotated, the inner circumference grinding stone 31 is fed from the first movement start position to the first movement end position (the inner circumference grinding stone 31 is moved in the C direction) and the outer circumference grinding stone 51 is fed from a first movement start position to a first movement end position (the outer circumference grinding stone 51 is moved in the A direction) at the same time (step 105). At this time, for example, a coolant liquid made from alkali solution is supplied to the cutting portion. This coolant liquid is used for purposes of promoting cooling, prevention of rusts on the apparatus, dressing (action to grind off the pad surface of the diamond grinding stone to expose a fresh surface of the pad) and the like.

In the processing at the step 105, the rotation of the inner circumference grinding stone 31 is carried out by the rotary driving unit 35 and the rotation of the outer circumference grinding stone 51 is carried out by the rotary driving unit 55. The rotation of the disk-shaped substrate 10 is carried out through the driving source 74. These rotations are made in opposite directions at the position where each grinding stone is opposed to corresponding circumference (contact direction), that is, both the inner circumference 12 and the outer circumference 13 are cut upward with respect to the rotation of the disk-shaped substrate 10. The disk-shaped substrate 10 and the outer circumference grinding stone 51 are rotated in the same direction, while the disk-shaped substrate 10 and the inner circumference grinding stone 31 are rotated in the opposite direction.

An example where the present exemplary embodiment is adopted is shown below.

Disk type: 1.89 inches

An outer circumference 13 of a disk-shaped substrate 10 is about Φ48 mm, and an inner circumference 12 thereof is about Φ12 mm.

Inner circumference grinding stone 31: The diameter is about 9 mm and the rotation number is about 10,000 to 12,000 rpm Outer circumference grinding stone 51: The diameter is about 160 mm and the rotation number is about 3,500 to 4,000 rpm Rotation number of the disk-shaped substrate 10 (workpieces): about 14 rpm Then, the servo motor 42 is controlled to move the inner circumference grinding stone 31 in the C direction, and the servo motor 62 is controlled to move the outer circumference grinding stone 51 in the A direction. At this time, the present exemplary embodiment is characterized by a distance between the first movement start position and the first movement end position on the inner circumference 12 side and a distance between the first movement start position and the first movement end position on the outer circumference 13 side being equal to each other. Thus, by making the movement distance of the grinding stone on the inner circumference side equal to that of the outer circumference side, starting the movement at the same timing and sliding them at the same speed, the inner circumference grinding stone 31 and the outer circumference grinding stone 51 reach the movement end positions at the same timing. That is, the feedings of the inner circumference grinding stone 31 and the outer circumference grinding stone 51 are stopped substantially at the same time. In an example shown in FIG. 4, the distance between the first movement start position and the first movement end position are set to 0.9 mm.

In the present exemplary embodiment, a distance d1 between the first movement start position on the inner circumference grinding stone 31 and the inner circumference 12 (See FIG. 4) and the distance d2 between the first movement start position on the outer circumference grinding stone 51 and the outer circumference 13 (See FIG. 4) is in a relation of:

$$d1>d2.$$

That is, when feeding is started at the same time from the first movement start positions and continued at the same speed, the outer circumference grinding stone 51 reaches the outer circumference 13 first and carries out grinding on the outer circumference 13. Then, the inner circumference grinding stone 31 reaches the inner circumference 12, and the inner and outer circumferences 12 and 13 are ground at the same time. The relation of d1>d2 is set and the outer circumference 13 is ground first, since in the receiving workpiece to be ground (the disk-shaped substrate 10), the dimensional accuracy of the outer circumference 13 is rougher than that of the inner circumference 12 in general and it is preferable that a grinding amount for the outer circumference 13 is larger than that for the inner circumference 12. At the first stage where the outer circumference grinding stone 51 is brought into contact with the outer circumference 13 but the inner circumference grinding stone 31 is not in contact with the inner circumference 12, grinding is only carried out for the outer circumference 13, and hence the condition is not preferable. However, after that, both the outer circumference grinding stone 51 and the inner circumference grinding stone 31 are brought into contact with the disk-shaped substrate 10 and the grinding work is carried out in a preferable cutting state. Consequently, the final grinding result turns to be favorable.

When the inner circumference grinding stone 31 and the outer circumference grinding stone 51 are fed to the first movement end position, the feeding operation by the servo motor 42 in the C direction and the feeding operation by the servo motor 62 in the A direction are finished. As mentioned above, start of the grinding is not necessarily matched, but end of the feeding operations is matched in the simultaneous grinding of the inner and outer circumferences. By matching the end of the feeding operations to each other, a desired cut amount may be ensured in a state where the concentricity of the inner circumference 12 and the outer circumference 13 is improved.

After that, the feeding is stopped at the movement end position and, while the position is maintained, the inner circumference grinding stone 31, the outer circumference grinding stone 51, and the disk-shaped substrate 10 are rotated for a predetermined time so as to perform so-called spark-out (step 106). As the predetermined time, for example, approximately 12 to 18 seconds is preferable. By this spark-out, the surfaces of the inner circumference 12 and the outer circumference 13 may be finished smoothly. In the spark-out, the rotation numbers of the inner circumference grinding stone 31 and the outer circumference grinding stone 51 are the same as the rotation numbers at the time of grinding while they are moved in the horizontal direction. On the other hand, the rotation number of the disk-shaped substrate 10 is increased according to a reduced load such as up to, for example, approximately 24 rpm so as to expedite the processing speed of the spark-out.

As mentioned above, the grinding processing of the rough grinding at the first stage by the rough grinding surfaces 32 and 52 is finished, and the grinding stones are separated from the disk-shaped substrate 10. That is, the servo motor 42 is controlled to move the inner circumference grinding stone 31 in D direction and the servo motor 62 is controlled to move the outer circumference grinding stone 51 in a B direction (step 107). Then, the servo motors 38 and 58 are controlled so as to move the inner circumference grinding stone 31 and the outer circumference grinding stone 51 in the Z1 direction that is the downward direction of the figure so that the finishing grinding surface 33 is opposed to the inner circumference 12 and the finishing grinding surface 53 is opposed to the outer circumference 13 (step 108) After that, the servo motors 42 and 62 are controlled to move the inner circumference grinding stone 31 in the C direction and the outer circumference grinding stone 51 in the A direction so as to feed them to the second movement start positions, respectively (step 109). In the example shown in FIG. 4, the first movement end position and the second movement start position are the same positions. At this time, it is preferable that the inner circumference grinding stone 31 and the outer circumference grinding stone 51 have been already rotated.

While the inner circumference grinding stone 31, the outer circumference grinding stone 51 and the disk-shaped substrate 10 are rotated, the inner circumference grinding stone 31 is fed from the second movement start position to a second movement end position (the inner circumference grinding stone 31 is moved in the C direction) and the outer circumference grinding stone 51 is fed from the second movement start position to the second movement end position (the outer circumference grinding stone 51 is moved in the A direction) (step 110). In the example shown in FIG. 4, a distance between the second movement start position and the second movement end position (the moving distance) is set to 0.1 mm. When the inner circumference grinding stone 31 and the outer circumference grinding stone 51 are fed to the second movement end positions, the feeding operation by the servo motor 42 in the C direction and the feeding operation by the servo motor 62 in the A direction are finished. By matching the end of the feeding operations to each other as mentioned above, a desired cut amount is ensured in the state where the concentricity of the inner circumference 12 and the outer circumference 13 is improved.

After that, the feeding is stopped at the second movement end position and, while the position is maintained, the inner circumference grinding stone 31, the outer circumference grinding stone 51 and the disk-shaped substrate 10 are rotated for a predetermined time so as to perform so-called spark-out (step 111). By this spark-out, the second stage which is the finishing grinding is finished. This predetermined period for performing the spark-out is approximately 12 to 18 seconds, for example. In the spark-out, the rotation numbers of the inner circumference grinding stone 31 and the outer circumference grinding stone 51 may be the same as the rotation numbers at the time of grinding while the inner circumference grinding stone 31 is moved in the C direction and the outer circumference grinding stone 51 is moved in the A direction. On the other hand, for example, the rotation number of the disk-shaped substrate 10 is increased according to a reduced load (for example, approximately 24 rpm) so as to expedite the processing speed of the spark-out. These conditions are similar to that in the first stage where the rough grinding is performed.

After that, the inner circumference grinding stone 31 and the outer circumference grinding stone 51 are moved in the direction away from the grinding position, that is, the inner circumference grinding stone 31 is moved in the D direction and the outer circumference grinding stone 51 in the B direction, and the inner circumference grinding stone 31 and the outer circumference grinding stone 51 are further moved in the Z2 direction (upward direction in FIG. 4) (step 112) so that the inner circumference grinding stone 31 and the outer circumference grinding stone 51 are retracted from the installed position of the disk-shaped substrate 10. Then, the second holding mechanism 72 (See FIG. 3) is moved in the Z direction in FIG. 3 so as to release the pressure on the disk-shaped substrate 10, the disk-shaped substrate 10 is removed by, for example, an automatic robot (not shown in the figure) (step 113), and the inner and outer circumference grinding process is finished.

In the grinding process of finishing grinding as the second stage, "the second movement start position" is set as "the first movement end position." However, "the second movement start position" may be considered as a position that is the position away from the ground surface rather than the first movement end position (the D direction in the grinding of the inner circumference 12 and the B direction in the grinding of the outer circumference 13). In the present exemplary embodiment, the moving distance in total for grinding of the rough grinding by the rough grinding surfaces 32 and 52 as the first stage and the finishing grinding by the finishing grinding surfaces 33 and 53 as the second stage is designed as 1 mm (0.9 mm+0.1 mm). For this reason, if the total moving distance is determined, "the second movement start position" is allowed to be separated from the ground surfaces.

Moreover, in the present exemplary embodiment, as shown in the step 106 and the step 111 in FIG. 5, the so-called spark-out is carried out in the rough grinding and the finishing grinding. However, the spark-out may be omitted particularly in the rough grinding shown in the step 106 as necessary.

Further, as an application of the present exemplary embodiment, a grinding method according to the shapes of the edge face and the slant face (a chamfered portion) of the disk-shaped substrate 10 may be employed.

Figure 6:
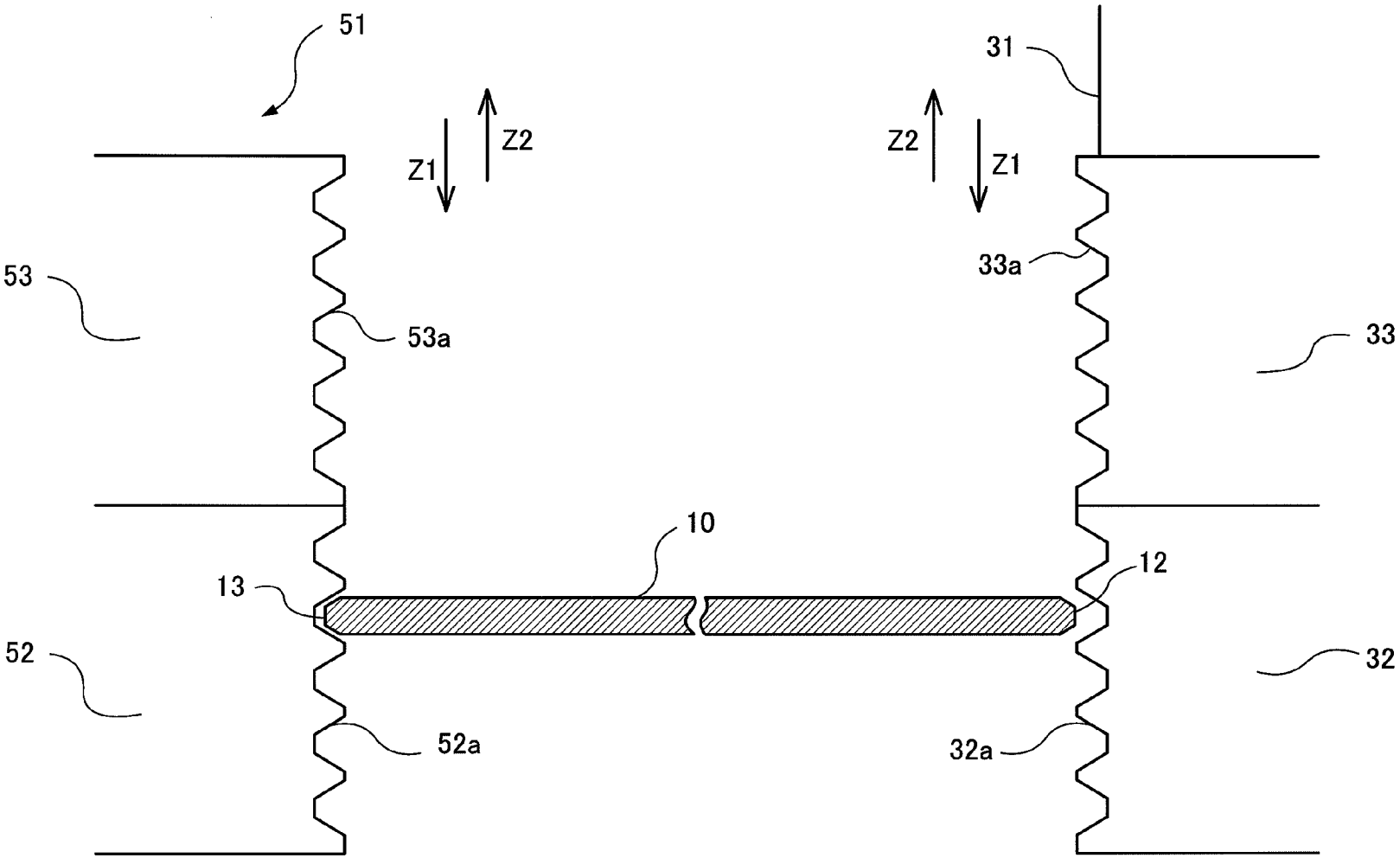
FIG. 6 is a view for explaining a structural example of the inner circumference grinding stone and the outer circumference grinding stone for simultaneous working on the edge faces and the slant faces of the disk-shaped substrate.

FIG. 6 is a view for explaining a structural example of the inner circumference grinding stone 31 and the outer circumference grinding stone 51 for simultaneous working on the edge faces and the slant faces of the disk-shaped substrate 10.

The edge face and the slant face (the chamfered portion) in which the corners of the edge face is chamfered are provided in the inner circumference 12 and the outer circumference 13. By providing the slant face (the chamfered portion), nonconformity such as a crack and chipping is restrained in various working processes and an assembling process. The inner circumference grinding stone 31 and the outer circumference grinding stone 51 shown in FIG. 6 are provided with trapezoidal grinding stone surfaces 32*a* and 33*a* on the cylindrical surface of the inner circumference grinding stone 31 and the trapezoidal grinding stone surfaces 52*a* and 53*a* on the cylindrical surface of the outer circumference grinding stone 51 for simultaneous grinding of the edge face and the slant face. The trapezoidal grinding stone surfaces 32*a*, 33*a*, 52*a* and 53*a* are worked corresponding to the ground shape of the edge face and the slant face (the chamfered portion) provided on the inner circumference 12 and the outer circumference 13 of the disk-shaped substrate 10. By bringing the edge face and the slant face (chamfered portion) of the disk-shaped substrate 10 into contact with one groove of the trapezoidal grinding stone surfaces 32*a*, 33*a*, 52*a* and 53*a*, the edge face and the slant face (chamfered portion) of the disk-shaped substrate 10 may be ground with high accuracy at the same time.

In the example shown in FIG. 6, plural (five in the example shown in FIG. 6) trapezoidal grinding stone surfaces 32*a* and 33*a* are provided on the rough grinding surface 32 and the finishing grinding surface 33 of the inner circumference grinding stone 31 respectively, and plural (five in the example shown in FIG. 6) trapezoidal grinding stone surfaces 52*a* and 53*a* are provided on the rough grinding surface 52 and the finishing grinding surface 53 of the outer circumference grinding stone 51 respectively. By this arrangement, even when, for example, one of the trapezoidal grinding stone surfaces 32*a*, 33*a*, 52*a* and 53*a* is abraded by grinding work, effective use of the grinding stones and continuous work is realized by other non-abraded trapezoidal grinding stone surfaces 32*a*, 33*a*, 52*a* and 53*a* by shifting in the Z1 direction or the Z2 direction.

As mentioned above in detail, in the present exemplary embodiment, in a grinding method of the disk-shaped substrate 10 in which the disk-shaped substrate 10 is ground, while rotating the disk-shaped substrate 10 having the hole at the center, the inner circumference 12 of the disk-shaped substrate 10 is ground while the inner circumferential grinding device is being fed in the outer circumferential direction, and the outer circumference 13 of the disk-shaped substrate 10 is ground while the outer circumferential grinding device is being fed in the inner circumferential direction. Then, when the inner circumferential diameter and the outer circumferential diameter of the disk-shaped substrate 10 become predetermined values, that is, when the same feeding amounts are set and dimensions after grinding are determined, the feedings of the inner circumferential grinding device and the outer circumference grinding device are stopped substantially at the same time. In the conventional inner and outer circumference simultaneous grinding, the finishing time is not controlled to become the same. The inner circumference is finished earlier, while the outer circumference is finished later in general. As a result, time for the spark-out becomes different, and cutting dimensions tends to be easily varied between the inner circumference and the outer circumference. According to the present exemplary embodiment, by grinding the inner circumference 12 and the outer circumference 13 while holding the disk-shaped substrate 10 and finishing the grindings at the same time, dimensional variation by grindings may be restrained. Moreover, for example, even when the grinding stone is abraded and cutting capability is deteriorated, relatively favorable cutting may be maintained for a long time. That is, even when the grinding stone is abraded and cutting capability is deteriorated, for example, while a load is changed on the outer circumference 13 side, variation in cutting on the other side, for example, the inner circumference 12 side may be restrained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A grinding method of a disk-shaped substrate that grinds a disk-shaped substrate including a portion having a hole at the center thereof while rotating the disk-shaped substrate, comprising:

grinding an inner circumference of the disk-shaped substrate while an inner circumference grinding device is fed in a radial direction toward an outer circumference of the disk-shaped substrate and grinding the outer circumference of the disk-shaped substrate while an outer circumference grinding device is fed in the radial direction toward the inner circumference of the disk-shaped substrate; and stopping the feedings of the inner circumference grinding device and the outer circumference grinding device at the same time.

2. The grinding method of a disk-shaped substrate according to claim 1, further comprising removing a portion remaining on the inner circumference and the outer circumference of the disk-shaped substrate by continuing rotation of the disk-shaped substrate for a determined time in the state of stopping the feedings.

3. The grinding method of a disk-shaped substrate according to claim 1, wherein the disk-shaped substrate is held by a holding device that presses and holds upper and lower surfaces of the disk-shaped substrate.

4. The grinding method of a disk-shaped substrate according to claim 1, wherein the inner circumference grinding device and the outer circumference grinding device have rotatable grinding surfaces.

5. The grinding method of a disk-shaped substrate according to claim 1, wherein each of the inner circumference grinding device and the outer circumference grinding device has a rough grinding portion and a finishing grinding portion.

6. The grinding method of a disk-shaped substrate according to claim 5, wherein the feedings of the inner circumference grinding device and the outer circumference grinding device in the radial direction are stopped at the same time in grinding by the rough grinding portions; and the inner circumference grinding device and the outer circumference grinding device are rotated for a predetermined time in a state where the positions of the inner circumference grinding device and the outer circumference grinding device are maintained.

7. The grinding method of a disk-shaped substrate according to claim 5, wherein the inner circumference grinding device and the outer circumference grinding device are grinding stones, each of the grinding stones continuously forming the rough grinding portion and the finishing grinding portion in an axial direction thereof; and after grinding by each of the rough grinding portions, grinding by each of the finishing grinding portions is performed by moving the inner circumference grinding device and the outer circumference grinding device in the axial direction so that each of the finishing grinding portions is opposed to the disk-shaped substrate.

8. The grinding method of a disk-shaped substrate according to claim 7, wherein the feedings of the inner circumference grinding device and the outer circumference grinding device in the radial direction are stopped at the same time during grinding by the finishing grinding portion; and the inner circumference grinding device and the outer circumference grinding device are rotated for a predetermined time in a state where the positions of the inner circumference grinding device and the outer circumference grinding device are maintained.

* * * * *